United States Patent [19]

Malecki

[11] 4,131,205

[45] Dec. 26, 1978

[54] CLOTHES-DRYING RACK

[75] Inventor: Alexander J. Malecki, Warminster, Pa.

[73] Assignee: General Home Products Corporation, Burlington, N.J.

[21] Appl. No.: 806,519

[22] Filed: Jun. 14, 1977

[51] Int. Cl.[2] ..... A47F 5/10

[52] U.S. Cl. ..... 211/200; 211/202

[58] Field of Search ..... 211/200, 202, 195, 201, 211/198, 199, 182

[56] References Cited

U.S. PATENT DOCUMENTS

| | | | |
|---|---|---|---|
| 1,533,470 | 4/1925 | Schmitt | 211/202 |
| 2,524,190 | 10/1950 | Cooper | 211/200 |
| 3,133,645 | 5/1964 | Cecil | 211/202 |

FOREIGN PATENT DOCUMENTS

| | | | |
|---|---|---|---|
| 166136 | 11/1955 | Australia | 211/200 |
| 919306 | 2/1963 | United Kingdom | 211/200 |
| 1009218 | 11/1965 | United Kingdom | 211/200 |

*Primary Examiner*—Ramon S. Britts
*Attorney, Agent, or Firm*—Nelson E. Kimmelman

[57] ABSTRACT

The novel rack has a first pair of generally inverted U-shaped rigid members so arranged that one member has its legs disposed within and pivotally joined to the corresponding legs of the other near the mid-points thereof. A second pair of generally inverted U-shaped rigid members substantially identical to the first pair and disposed and pivotally joined to one another in a manner substantially identical to the first pair is positioned atop the first pair. The free ends of the legs of the second pair are pivotally connected to the legs of the first pair where the legs of the first pair join the bights. Rigid bracing means are provided which releasably interconnect the two members of said first pair and releasably lock it into non-collapsed condition. Plastic cord means are threaded into the bracing means and the rigid members to allow articles such as drying clothes, to be supported therefrom when the rack is in its non-collapsed condition.

In another form, the rack has a single upper, generally inverted-U-shaped rigid member whose legs are connected at or near their respective mid-points to a pair of rigid member and also has a bracing means comprising a single generally horizontal U-shaped member coupled to said single upper rigid member and to said pair of rigid members.

12 Claims, 9 Drawing Figures

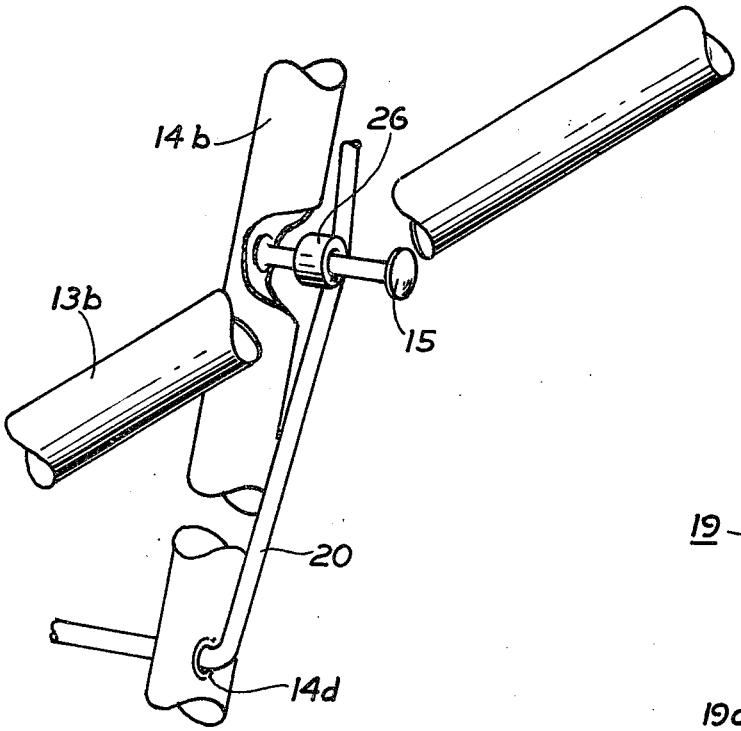
FIG. 3
FIG. 4
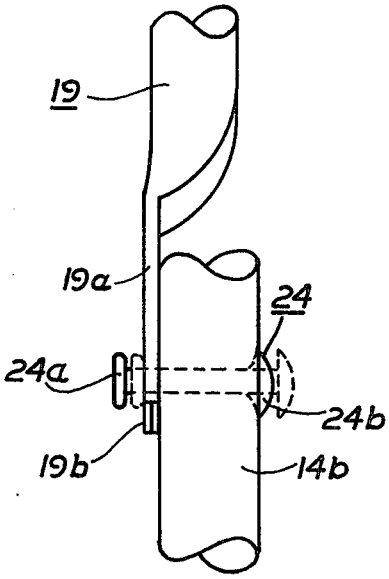
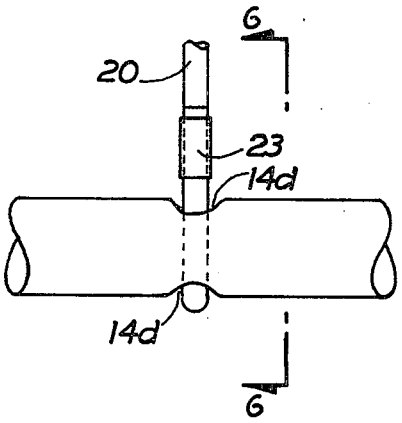
FIG. 5
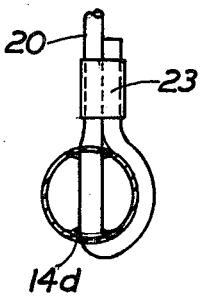
FIG. 6

CLOTHES-DRYING RACK

BACKGROUND OF THE INVENTION

A. Field of the Invention

This invention relates to racks and in particular to a collapsible portable rack suitable for suspending drying clothes or the like.

B. Prior Art

There have been many racks such as clothes-drying racks in the past which have been portable and collapsible. Many of them were made of wood side supports with wood dowels. These racks were rickety and unstable when in their non-collapsed condition, being especially subject to structural deformation when weight or pressure was applied in a vertical plane. Furthermore, the horizontal wooden dowels often became splintery or, if painted, became unsightly after the painted finish came off partially or totally. Being wood, the members also were subjected to structural deformation due to warping. The pins or nails used to connect the wooden cross-members often became loose or became oxidized. This was true even if the wooden dowels were covered with tubular plastic material. It was therefore highly desirable to provide a rack which did not have these defects and which enabled drying clothes, for example, to be firmly held without snagging due to splintering or discoloration due to deterioration of the finish of the supporting dowels or other parts of the rack into which the clothes might come into contact. Furthermore, it was desired to have a rack which maintained structural rigidity yet was light enough to be portable and was easily collapsed for convenient storage. Toward these objects, the present invention is directed.

BRIEF SUMMARY OF THE INVENTION

A collapsible rack comprises a first pair of generally inverted U-shaped rigid members, one member having its legs disposed within and pivotally joined to the corresponding legs of the other, a second pair of generally inverted U-shaped rigid members substantially identical to the said first pair and disposed and pivotally joined to one another in a manner substantially identical to the first pair, the second pair also having at the free ends of its legs pivotal connections to the first pair, releasable means associated with the second pair for bracing the rack in non-collapsed condition, and means associated with selected ones of the first and second pairs and said bracing means for enabling articles to be supported therefrom.

BRIEF DESCRIPTION OF THE DRAWINGS

FIG. 3 is an enlarged fragmentary view in perspective and partly broken away of the part of the apparatus shown in FIG. 2 enclosed within the broken-line circle numbered "3";

FIG. 4 is a fragmentary enlarged view of the means for releasably locking the bracing means to maintain the rack in non-collapsed operating condition;

FIG. 5 is an enlarged fragmentary view taken from above of the portion of the apparatus shown in FIG. 2 within the broken-line circle "5";

FIG. 6 is a view of the apparatus shown in FIG. 5, partly in section, taken along the section line 6—6 in the direction indicated;

DETAILED DESCRIPTION OF THE DRAWINGS

Figure 1:
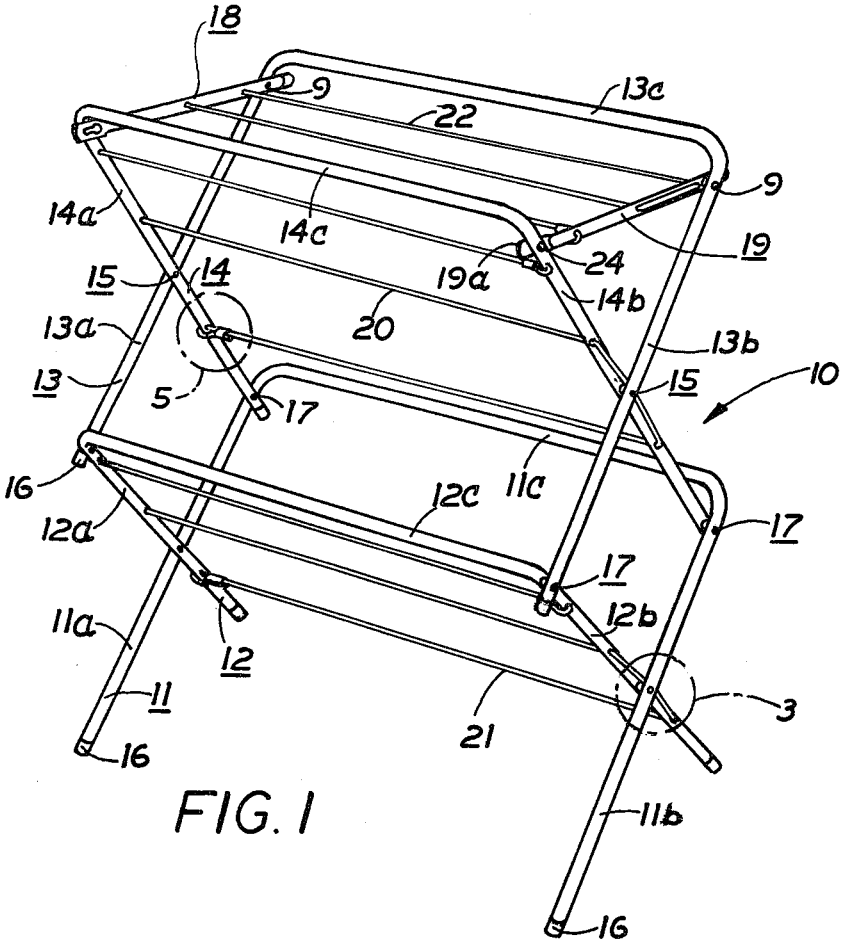
FIG. 1 is a perspective view of the novel rack according to the present invention as shown in a non-collapsed condition.

FIG. 1 shows the novel drying rack indicated generally at the numeral 10 having a first pair of generally inverted-U-shaped members 13 and 14 and a second pair of substantially similar members 11 and 12 which may be made of a rigid material such as metal, for example, that may be covered with paint or other appropriate finish, if desired. Each member has a central bight joined to legs whose ends are covered with, for example, plastic caps 16 to prevent marring of the floor and harm to the person using the rack.

It will be noted that with respect to the first or upper pair of rigid members 13 and 14, the legs **14*a* and 14*b* of the member 14 are disposed within the legs 13*a* and 13*b* of the member 13 so that the distance between the legs 14*a* and 14*b* is somewhat smaller than the distance between the legs 13*a* and 13*b* for this purpose. Similarly, the bight 14*c* is somewhat shorter than the bight 13*c*. Member 14 is joined to member 13 by pivot pins or rivets 15** at points generally intermediate the length of the respective legs as shown.

Its second pair of generally-U-shaped members 11 and 12 are generally constructed and arranged relative to one another substantially identical to the first pair 13, 14. The lower pair is also pivotally connected to the upper pair by means of pivots 17. These pivot points are located toward the ends of the legs of the upper pair and where the legs of the lower pair join the bights. As seen in FIG. 1, the slightly smaller member 12 is positioned within the legs of the member 13 near the region of the pivot 17. Similarly, the free ends of the legs of the member 14 are positioned within the slightly wider member 11 in the region of the pivot 17.

To brace the rack, bracing members 18 and 19 are connected between the members of the first pair at points at the regions where the legs of the first pair join the bights. At one end of each member 18, 19, it is pivotally pinned to the member 13 by pivot pins 9 which pass through corresponding aligned apertures in the members 18, 19 and the legs **13*a*, 13*b*. The free ends of the bracing members have flattened portions such as 19*a* in which a key-hole aperture such as 19*b* is formed. The bracing members pins are located within the member 14 and the member 13 as shown. When the rack is in the erect, non-collapsed condition as shown in FIG. 1, the bracing members 18 and 19 are so positioned that the larger part of the key hole 19*b* is opposite the laterally-movable securing pin 24 whose smaller flat end 24*a* is initially held very close to the surface of the legs 14*b*. The user then presses the larger right end 24*b* to the left so that the end 24*b* moves horizontally through the larger part of key hole 19*b*. The opposite process is carried out on the left side of the apparatus where another securing pin 24 is pressed to the right in its aperture formed in leg 14*a* through the larger part of the key hole. The natural weight of the rack or a slight pressure downward upon the bights 14*c* and 13*c* will cause the latter to move away from one another so that the smaller ends 24a will ride into the narrower parts of the key holes thereby preventing them from being dislodged. Clothes-suspending cord 22 is provided for use with the bracing members 18 and 19 which are provided with a series of apertures along their length. The cord 22, which might be made of smooth white plastic, for example, has one end knotted and the other end passed through a hole in bracing member 18 across to bracing member 19 whence it passes through a corresponding hole, turns down against the member 19, passses through the next adjacent hole and goes to the aligned hole in the member 18 on the opposite side, much as conventional horizontal strings of tennis rackets are strung. The other end of the cord 22 is terminated by being passed through a hole, then back over the brace 19 and fixed in place by a metal or similar clamp such as the clamp 23 shown in FIGS. 5 and 6. FIGS. 5 and 6 show how cord 20 is terminated although it is equally applicable to the termination of the cord 21. Also, as shown in FIGS. 5 and 6, the holes in the bracing members 18 and 19 and the legs may be formed with depressed dimples (see 14d, FIG. 6**) that allow the cord to make more gradual turns.

FIG. 3 shows how the cord 20, for example, is disposed after it passes through a hole in the upper part of leg 14b and before it is threaded through the next lower hole in that leg for return to the final hole in opposite leg 14a and termination thereat. From FIG. 3 it is seen that a plastic spacer 26 is interposed between leg 14b and the leg 13b where they are pivotally coupled by pivot pin 15 which passes through the spacer 26. The space is sufficient to allow the cord 20 to come into contact with the spacer 26 and yet not be pinched or rubbed by the pivoting movement of the legs 13b and 13a with respect to one another during erection or collapsing of the rack.

Figure 2:
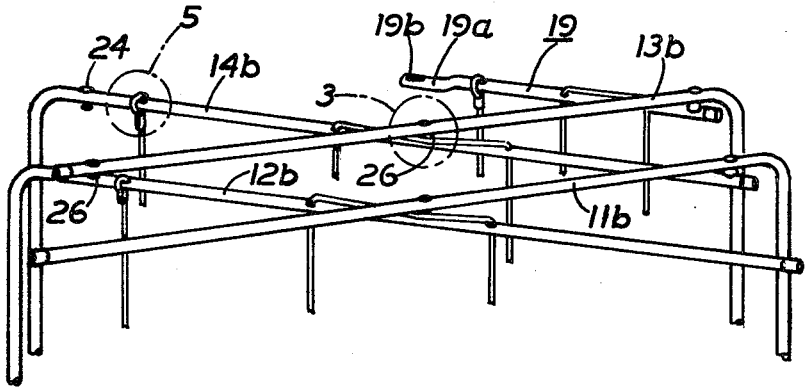
FIG. 2 is a fragmentary, perspective view taken from the right and from below the apparatus shown in FIG. 1, showing the rack in almost collapsed condition.
Figure 7:
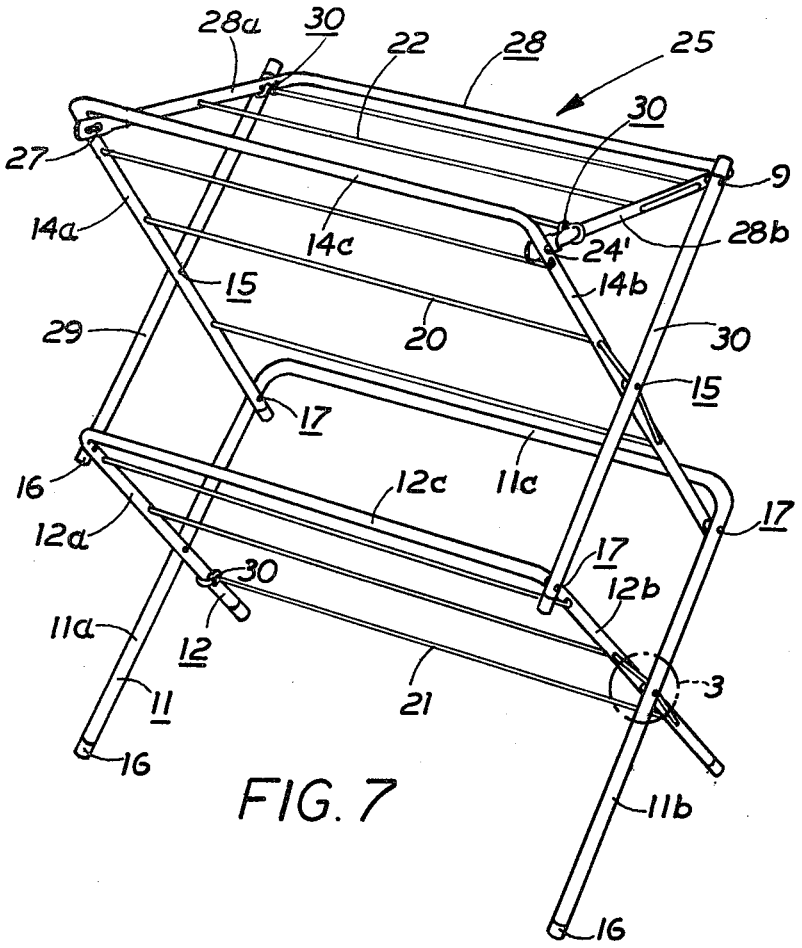
FIG. 7 is a perspective view of another form of the present invention.
Figure 9:
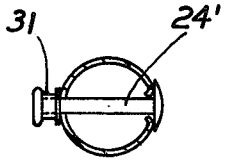
FIG. 9 is an enlarged, fragmentary view of another part of the apparatus shown in FIG. 7.

FIG. 7 shows still another form of the invention 25 having a somewhat different structure in the upper part of the rack. Instead of having separate straight brace members such as members 18 and 19 as shown in FIGS. 1 and 2, the rack of FIG. 7 uses still another integral, generally inverted-U-shaped member 28 having leg portions 28a and 28b respectively whose ends are flattened and provided with keyhole apertures 27 substantially identical to the ends of the brace members 18 and 19 in the former embodiment. Since the bight of this horizontal bracing member 28 provides structural stability, it is no longer necessary to have another upper generally inverted-U-shaped member such as member 13 (FIG. 1) with its bight portion 13c. Also, when the unit is collapsed, it is necessary to permit the bight of the member 28 to be moved to a position generally parallel to the members to which it is pivotally attached. Therefore, rigid side members 29 and 30, without any interconnection between them are used instead. It has been found that this alternative construction provides the necessary structural stability as measured in the horizontal direction and also facilitates the erection of the rack. The flattened ends of the portions 28a and 28b and their respective associated keyhole-shaped apertures 27 cooperate with the pins 24' in substantially identical fashion as the keyhole apertures do with pin 24 shown in FIGS. 1 and 2. (FIG. 9)

Figure 8:
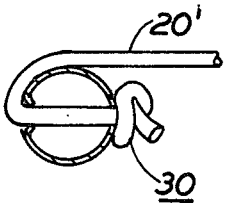
FIG. 8 is an enlarged detail of part of the apparatus shown in FIG. 7.

In FIG. 7, as shown, clips such as clips 23 are not used. Instead, as shown in FIG. 8, the ends of the cord 20' are maintained in place by simple knots 30 thereby allowing the user to adjust the tension of the cord as desired.

What is claimed is:

1. A collapsible rack comprising:

a. a first pair of integral generally inverted U-shaped rigid members made of metal, one of which has its legs disposed inwardly of and pivotally joined to the corresponding legs of the other near the midpoints thereof, b. a second pair of integral generally inverted-U-shaped rigid members made of metal and being substantially identical to said first pair and disposed and pivotally joined to one another in a manner substantially identical to said first pair, said second pair also having at the free ends of its rigid members pivotal connections to said first pair at points on the legs of said first pair in the regions where they join the bights thereof, c. means associated with said second pair and releasably connectable therebetween for bracing said rack in non-collapsed condition and also for maintaining said rack in said condition, and d. elongated flexible cord means associated with selected ones of said first and second pairs and said bracing means for enabling articles to be supported therefrom, each of said cord means associated with one of said pairs comprising a continuous length of cord strung parallel to the bight of the inverted U-shaped member of said pair, and wherein one of said members of each of said first and second pairs has its legs separated from one another by a distance which is smaller than the distance separating the legs of the other member of its pair so as to provide a space between corresponding adjacent ones of said legs which is at least about as large as the diameter of said cord thereby to allow said parts of the lengths of cord to pass in said space between said legs without being appreciably pinched during collapsing or erection of said rack.

2. The collapsible rack according to claim 1 wherein the free ends of the member of said second pair having a smaller inter-leg distance is positioned inwardly of the legs of the first pair having a larger inter-leg distance than the other member of the first pair and wherein the free ends of the member of said second pair having the larger inter-leg distance is positioned outwardly of the rigid member of said first pair having a smaller inter-leg distance.

3. The collapsible rack according to claim 1 wherein said bracing means comprises two substantially rigid members having corresponding ends pivotally connected to one of the members of said second pair and opposite corresponding ends releasably securable to the other member of said second pair.

4. The collapsible rack according to claim 3 wherein said releasably securable ends are provided with apertures and wherein the rigid member to which they are releasably secured include movable pins for engaging said apertures.

5. The collapsible rack according to claim 8 wherein said apertures are generally keyhole-shaped and wherein said movable pins have respectively larger outer ends and pass through apertures in the legs of the one of said members of said second pair with which they are associated and wherein said pins have inner enlarged ends smaller than the larger part of said keyhole apertures and adapted to pass into the smaller part of said apertures.

6. A collapsible rack comprising a. a first generally inverted-U-shaped integral rigid member made of metal, b. a pair of generally straight rigid members made of metal, each being pivotally coupled to a corresponding leg of said first rigid member, c. a second integral and generally inverted-U-shaped rigid member made of metal pivotally coupled to said straight rigid members and including a portion for releasably connecting it to said first U-shaped member for bracing said rack in its non-collapsed condition, d. third and fourth integral and generally inverted-U-shaped rigid members made of metal each of whose legs are pivotally coupled to the corresponding legs of the other near the mid-points thereof, said third rigid member being substantially identical to said first rigid member, said third rigid member also being pivotally coupled to said two straight rigid members and said fourth rigid member being pivotally coupled to said first rigid member, and e. flexible cord means strung parallel to the bights of selected ones of said first, second and third rigid members for enabling articles to be supported therefrom, said cord means comprising a first continuous length of cord strung in apertures in the legs of said first rigid member, a second continuous length of cord strung in apertures in the legs of said second rigid member and a third continuous length of cord strung in apertures in the legs of said third rigid member, said first and second rigid members having their respective adjacent legs separated from one another at their connecting points by spacer means maintaining a space sufficient to permit a part of said first cord strung in said first member to pass between said adjacent legs thereby to permit said rack to be collapsed or erected without appreciable disturbance from said first cord.

7. The collapsible rack according to claim 6 wherein said pair of generally straight rigid members are pivotally coupled to the corresponding legs of said first rigid member near the respective mid-points thereof, wherein said second generally inverted-U-shaped rigid member maintains said rack in its non-collapsed condition when it is bracing said rack, and wherein the legs of said third rigid member are disposed inwardly of the corresponding legs of said fourth rigid member, and wherein said fourth rigid member is pivotally coupled to said first rigid member toward the free ends of the latter.

8. The collapsible rack according to claim 6 wherein said flexible cord means are associated with said first, second and third rigid members.

9. The collapsible rack according to claim 7 wherein said second generally inverted-U-shaped rigid member is pivotally coupled at the points in the regions where the legs thereof join the bight thereof to corresponding free ends of said pair of generally straight rigid members.

10. The collapsible rack according to claim 6 wherein said portion for releasably connecting said second rigid member to said first rigid member includes apertures toward the free ends of the legs of said second rigid member and wherein said first rigid member includes generally horizontally movable members which may be moved into withdrawable engagement with said apertures.

11. The collapsible rack according to claim 6 wherein said third and fourth members also have their respective adjacent legs separated from one another at their connecting points by additional said spacer means maintaining a space sufficient to permit a part of said third cord to pass between them.

12. The collapsible rack according to claim 6 wherein said spacer means maintains a space between said respective adjacent legs at their connecting points which is at least about as large as the diameter of said first cord.

* * * * *